US007836523B2

(12) United States Patent
Castle

(10) Patent No.: US 7,836,523 B2
(45) Date of Patent: Nov. 23, 2010

(54) WEFT-BEARING BABUSHKA WITH HIDDEN CONNECTION

(76) Inventor: Keela F. Castle, 6125 Canterbury Dr., #312, Culver City, CA (US) 90230

( * ) Notice: Subject to any disclaimer, the term of this patent is extended or adjusted under 35 U.S.C. 154(b) by 63 days.

(21) Appl. No.: 12/283,336

(22) Filed: Sep. 10, 2008

(65) Prior Publication Data

US 2010/0058515 A1 Mar. 11, 2010

(51) Int. Cl.
*A42B 1/00* (2006.01)

(52) U.S. Cl. ..... 2/207; 2/202; 2/204; 2/174

(58) Field of Classification Search ..... 2/207, 2/202, 204, 174
See application file for complete search history.

(56) References Cited

U.S. PATENT DOCUMENTS

| | | | | |
|---|---|---|---|---|
| 2,574,558 | A | 11/1951 | Graber | |
| 2,651,310 | A | 9/1953 | Selson | |
| 2,730,722 | A * | 1/1956 | Colangelo | 2/202 |
| 2,889,557 | A | 6/1959 | Blair | |
| 3,460,546 | A | 8/1969 | Abbott | |
| 3,636,962 | A | 1/1972 | Frackowiak | |
| 3,782,396 | A | 1/1974 | Tomlinson | |
| 3,910,292 | A | 10/1975 | Izzo | |
| 4,492,242 | A | 1/1985 | Dalton | |
| 4,599,749 | A | 7/1986 | Childs | |
| 4,804,003 | A | 2/1989 | Moen | |
| D357,343 | S * | 4/1995 | O'Neal et al. | D2/866 |
| D605,379 | S * | 12/2009 | James | D2/866 |
| 2006/0174905 | A1 | 8/2006 | Bias | |
| 2007/0113319 | A1 * | 5/2007 | Brinn et al. | 2/174 |

FOREIGN PATENT DOCUMENTS

| | | | |
|---|---|---|---|
| JP | 03-036565 | U9 | 2/1997 |
| JP | 03-052496 | U9 | 7/1998 |
| JP | 11-256406 | A | 9/1999 |
| JP | 2005-068628 | A | 3/2005 |
| KR | 20-1974-0000797 | Y1 | 7/1974 |

* cited by examiner

*Primary Examiner*—Gary L Welch
*Assistant Examiner*—Alissa J Tompkins
(74) *Attorney, Agent, or Firm*—Berliner & Associates

(57) ABSTRACT

A two ply head covering in the form of a triangular scarf or babushka in which a weft of hair is secured to extend directly from the front edge of the babushka between opposing inturned forward edges of the babushka.

7 Claims, 3 Drawing Sheets

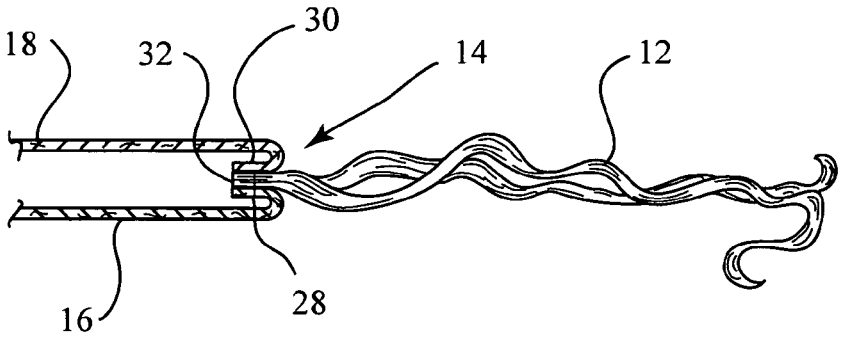
Fig. 2A
Fig. 2B
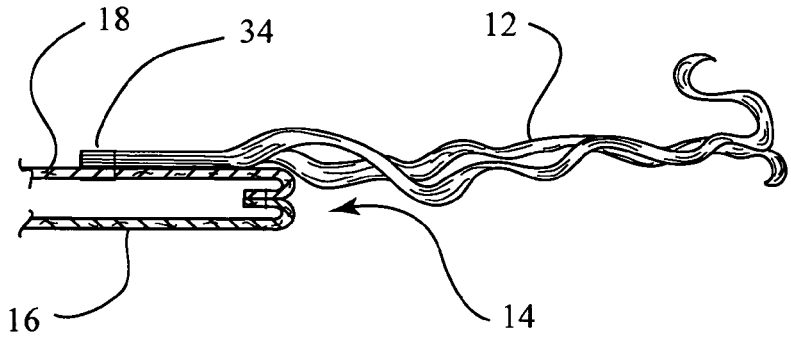
Fig. 6
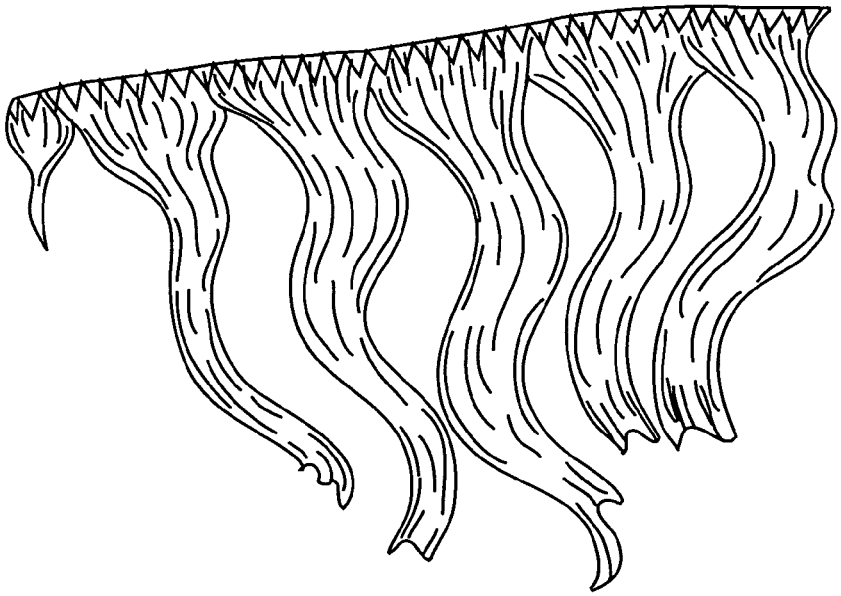

WEFT-BEARING BABUSHKA WITH HIDDEN CONNECTION

FIELD OF THE INVENTION

The invention relates to weft-bearing babushkas or head scarves.

BACKGROUND OF THE INVENTION

There have been many attempts to provide head coverings that also serve to carry hair pieces such as wiglets. Some prior art embodiments have provided a convenient hair covering for people with hair loss, including women under chemotherapy treatment. Others have been additionally, or solely, for ornamental purposes to provide a quick method of showing stylish tresses that would have been expensive or time consuming to obtain, or otherwise not possible with the woman's natural hair. Even those who possess full, attractively coifed wigs, it is often desirable instead to use a head scarf carrying tresses or wiglets to avoid the time necessary to properly put on and adjust a full wig, for example when a woman wants to quickly run to a store from home. Moreover, full wigs are often hot and sweaty or otherwise uncomfortable to wear, so an alternative is desirable to provide relief from such discomfit.

Examples of prior efforts to provide such hair-adorned scarves or babushkas include U.S. Pat. No. 2,574,558 titled "Ornamental Hair Covering," U.S. Pat. No. 3,460,546 titled "Scarf Hairpiece," U.S. Pat. No. 3,910,292 titled "Hair Coverings with Interchangeable Components," and U.S. Pat. No. 4,492,242 titled "Head Scarf for Women with Hair Loss." Other prior art that is more remote includes caps or hats or the like with dependent tresses, for example in U.S. Pat. No. 2,651,310 titled "Hair Conforming Mounting for Adjustably Positionable Hair Pieces," U.S. Pat. No. 2,889,557 titled "Boudoir Cap," U.S. Pat. No. 3,636,962 titled "Woman's Hat with Depending Hair Tresses," U.S. Pat. No. 3,782,396 titled "Detachable and Interchangeable Combination Wig and Hat," U.S. Pat. No. 4,599,749 titled "Cap for Women to Conceal Hair Loss," and U.S. Pat. No. 4,804,003 titled "Combined Head-Covering and Wiglet." Each of the foregoing prior art patents are incorporate herein by reference.

There are significant problems with each of the foregoing references. Some use detachable hair pieces or permanent attachment by tape or by bulky connection, each lying directly on the skin, or which requires a hair piece secured to the undersurface of the scarf and/or a distance from the forward edge of the scarf (as compared to the sides, which are not as important to comfort or looks). Hair pieces are used to provide bangs or tresses depending as a fringe of hair combed or brushed forward over the forehead as a fringe over the woman's forehead. By having the hair piece spaced inwardly from the front edge, there is a constant possibility of the material of the scarf lifting in a gust of wind to expose the attachment. Detachable hair pieces require the use of connectors, tape securements, and stitching of the hair piece to the undersurface of the scarf, add weight and bulk and can suffer wear from repeated washings that deteriorate the securement of the attachment mechanism. Moreover, the prior art scarf materials are generally of one ply construction, contributing to the foregoing disadvantages.

BRIEF SUMMARY OF THE INVENTION

The present invention overcomes the foregoing drawbacks by providing a two ply head covering in the form of a triangular scarf or babushka in which a weft of hair (as described below in the Detailed Description of the Invention) is secured to extend directly from the front edge of the babushka between opposing inturned forward edges of the babushka. Each of the foregoing requirements is important to the comfort, quality and ability of the babushka to give the impression of natural hair, while avoiding all of the drawbacks referred to above. Preferably, the weft is secured by stitching to opposing inturned forward edges of the babushka. Not as critical are side areas of the babushka where wefts can be secured with less severe requirements for a number of reasons. Since the side wefts are on the side of the head, there is little negative impact, if any, on the head of the wearer where perspiration and fit are not as critical. Moreover, wind gusts do not raise the side edges of the babushka, which is tied to the head.

BRIEF DESCRIPTION OF THE DRAWINGS

For a more complete understanding of the present invention, reference is now made to the following descriptions taken in conjunction with the accompanying drawing, in which:

FIG. 2A is a cross section of the forward edge of the babushka of FIG. 2 taken on line 2A-2A of FIG. 2;

FIG. 2B side is a cross section of one of the side edge of the babushka of FIG. 2 taken on line 2B-2B of FIG. 2;

FIG. 6 is a planar view of the weft shown in FIG. 2A.

DETAILED DESCRIPTION OF THE INVENTION

Figure 1:
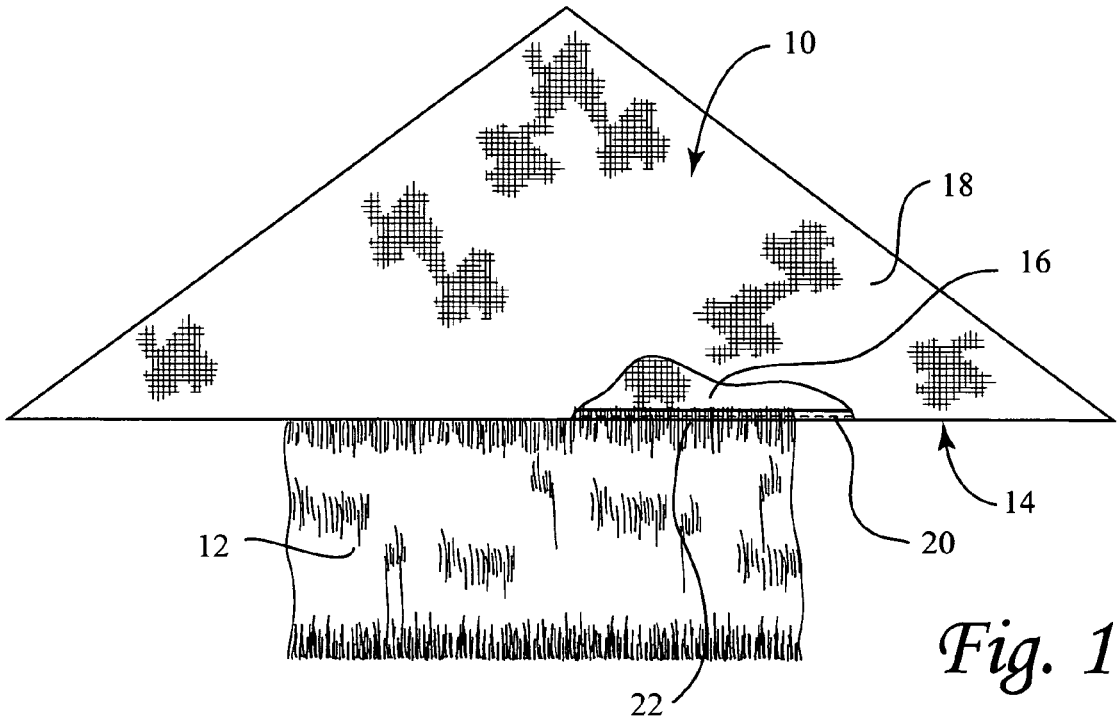
FIG. 1 is a bottom planar view of one embodiment of the babushka of the invention, showing a weft extending directly from the front edge of the babushka to provide bangs.

As indicated in the Summary of the Invention, the invention comprises a two ply head covering in the form of a triangular scarf or babushka in which a weft of hair is secured to extend directly from the front edge of the babushka between opposing inturned forward edges of the babushka. A weft is a hairdressing term for temporary hair extensions sewn on a fine base and used in the process of hair weaving to provided what is referred to as wefted hair. Wefts are commercially available in a wide variety of hair styles and lengths. While normally used to weave into a persons natural hair, in this invention, the weft is, rather, stitched by its base or otherwise secured to opposing inturned forward edges of the babushka. Referring to FIG. 1, one embodiment of the invention is shown. A babushka 10, i.e., a triangular head scarf, has a weft 12 extending as bangs directly from the forward edge 14 of the babushka 10. The babushka 10 is formed of two plies, a top ply 16 and bottom ply 18. The plies are shown in reverse order in the drawing to better illustrate the babushka construction, top referring. The word top is meant to refer to the outer ply when worn and the bottom ply is meant to refer to the ply that is in contact with the wearer's head. The two plies are connected by stitching 20, preferably entirely around the edges of the babushka 10. As shown in FIG. 1, the weft 12 is stitched directly to the seam 22 of the babushka's forward edge 14. In the event that a single weft of hair does not have sufficient thickness of hair to be aesthetically pleasing, a combination of two, or more, wefts may be used or a long weft may be doubled over.

Wefts have not previously been used in the context of this invention, namely, in a two ply head covering in the form of a triangular scarf or babushka in which the weft is secured to extend directly from the front edge of the babushka between opposing inturned forward edges of the babushka. The details of such securement will be shown below in FIG. 2A.

FIG. 2A shows the top and bottom plies, respectively 16 and 18, with their respective edges 28 and 30 inturned to form the forward edge 14 of the babushka and to sandwich the weft 12 between them, secured by stitching 32 through the edges 28 and 30 and proximal edge of the weft 12 to extend directly from the front edge 14 of the babushka 10. The proximal edge of the weft 12 is coterminous with the inturned forward edges 28 and 30 of the babushka.

Figure 2:
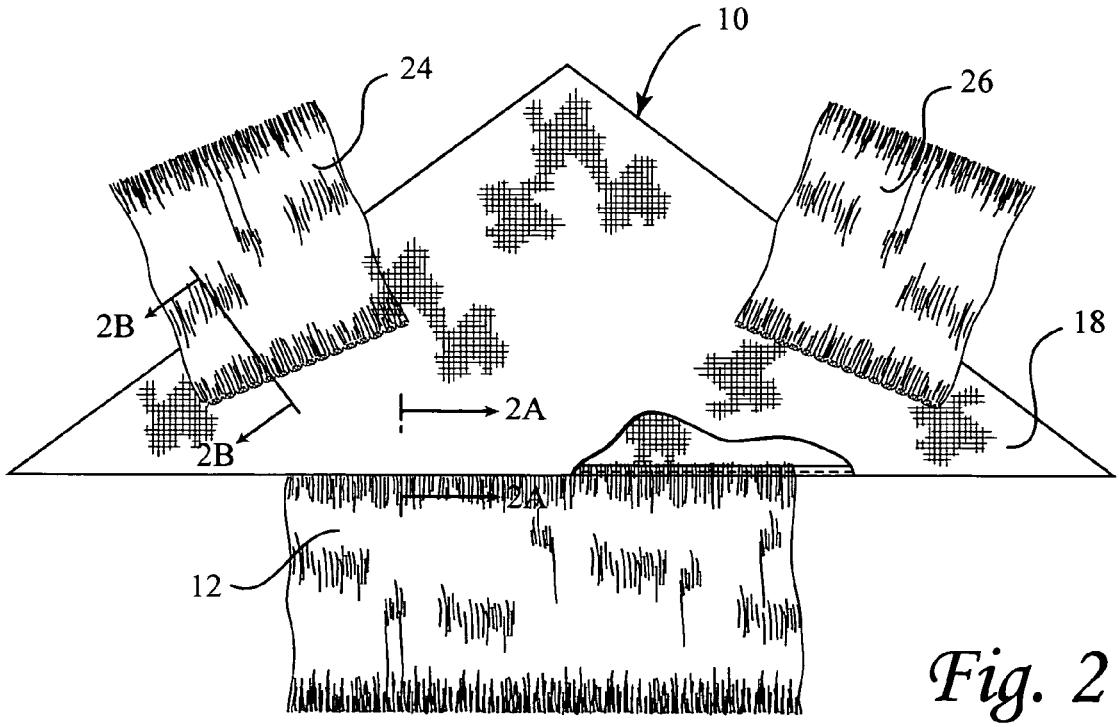
FIG. 2 is a bottom planar view of another embodiment of the invention showing a weft extending as bangs directly from the front edge of the babushka as well as showing wefts extending form the underside of the babushka spaced inwardly from the side edges of the babushka.

Another embodiment is shown in FIG. 2 where a pair of wefts 24 and 26 are secured to the bottom head babushka ply 18 by stitching. Because the wefts 24 and 26 are used as side pieces, they are not subject to the problem of exposure when the wind gusts. FIG. 2B also shows the top and bottom plies, respectively 16 and 18, with their respective edges 28 and 30 inturned, but in this case, the weft 24 is stitched at 34 to the bottom ply 18 of the babushka 10.

Figure 3:
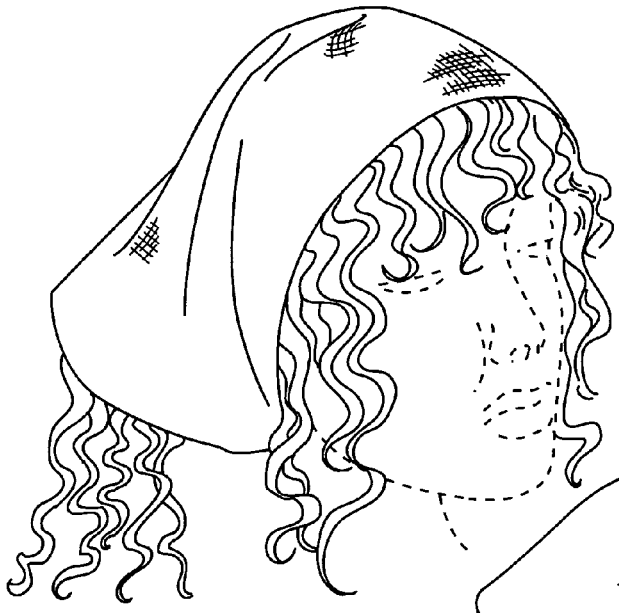
FIG. 3 shows a side-frontal perspective view of a babushka of the invention as worn by a woman, tied in the rear of the head
Figure 4:
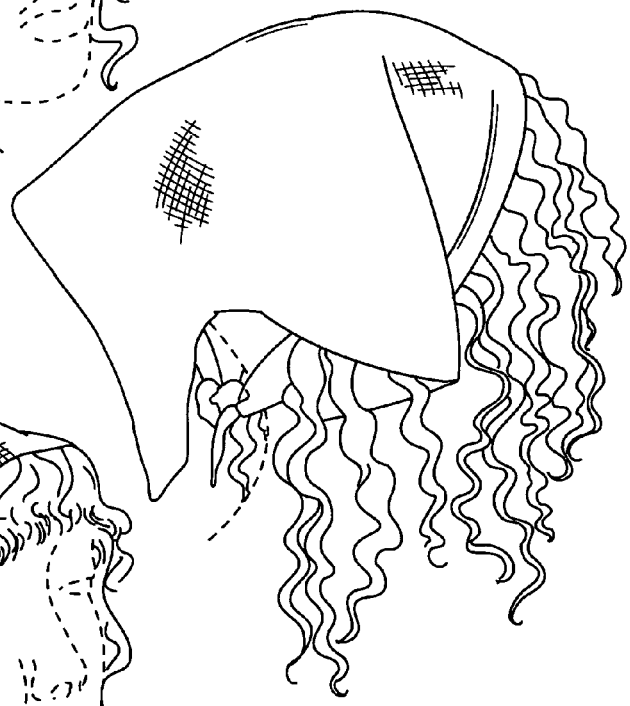
FIG. 4 shows a side-rear perspective view of a babushka of the invention worn as in FIG. 3.
Figure 5:
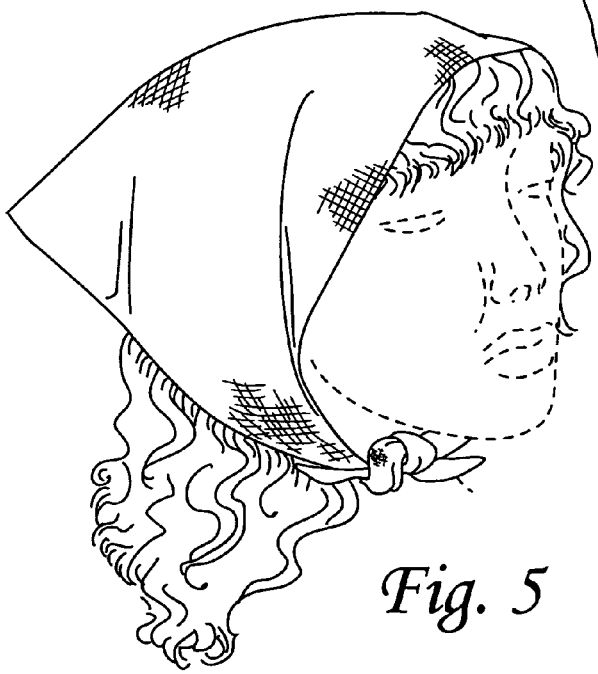
FIG. 5 shows a side-frontal perspective view of a babushka of the invention as worn by a woman, tied below the chin.

FIGS. 3, 4 and 5 show a woman wearing the babushka tied in the back of the head, by the neck in FIGS. 3 and 4, and below the chin in FIG. 5.

Although the present invention has been described in connection with the preferred embodiments, it is to be understood that modifications and variations may be utilized without departing from the principles and scope of the invention, as those skilled in the art will readily understand. Accordingly, such modifications may be practiced within the scope of the following claims.

The invention claimed is:

1. A two ply head covering in the form of a triangular scarf or babushka a having opposing inturned forward edges forming a front edge of the scarf or babushka, and at least one weft of hair having a base, the opposing inturned forward edges sandwiching only the base between them and secured to the base whereby the weft of hair extends directly from the front edge of the scarf or babushka.

2. The head covering of claim 1 in which the weft of hair is secured by stitching to the opposing inturned forward edges of the scarf or babushka.

3. The head covering of claim 1 in which weft base has a top edge, and the top edge of the weft base is coterminous with the inturned forward edge of the scarf or babushka.

4. The two ply head covering of claim 1 stitched entirely around its edges.

5. The two ply head covering of claim 1 in which the two plies comprise a top ply having a top side and a bottom ply having an underside and in which the head covering includes side wefts connected to the underside of the bottom ply of the head covering to extend from the side edges of the scarf or babushka.

6. The two ply head covering of claim 4 in which the side wefts are stitched to the bottom ply of the head covering but not to the top ply of the head covering.

7. A two ply head covering, comprising a top having a top side and a bottom ply having an underside, in the form of a triangular scarf or babushka stitched entirely around its edges forming front and side edges of the scarf or babushka, the top and bottom plies having opposing inturned forward edges, a weft of hair having a base coterminous with the inturned forward edges of the scarf or babushka, the opposing inturned forward edges, sandwiching only the base between them and secured to the base by stitches whereby the weft of hair extends directly from the front edge of the scarf or babushka and in which the head covering includes side wefts connected to the underside of the bottom ply, but not to the top ply, of the head covering to extend from the side edges of the scarf or babushka.

* * * * *